US005176364A

United States Patent [19]

Bell

[11] Patent Number: 5,176,364

[45] Date of Patent: Jan. 5, 1993

[54] DIRECT DRIVE HYDRAULIC WIRELINE WINCH ASSEMBLY

[75] Inventor: Danny R. Bell, Webster, Tex.

[73] Assignee: Camo International Inc., Houston, Tex.

[21] Appl. No.: 575,118

[22] Filed: Aug. 30, 1990

[51] Int. Cl.[5] ..... B66D 1/08

[52] U.S. Cl. ..... 254/291; 254/361

[58] Field of Search ..... 254/291, 361, 315, 293

[56] References Cited

U.S. PATENT DOCUMENTS

| | | | |
|---|---|---|---|
| 4,345,742 | 8/1982 | Morfitt | 254/291 |
| 4,432,532 | 2/1984 | Overholt | 254/291 |
| 4,454,912 | 6/1984 | Fröhlich et al. | 254/361 |
| 4,555,092 | 11/1985 | Overholt | 254/291 |
| 4,756,366 | 7/1988 | Maroney et al. | 254/361 |
| 4,760,971 | 8/1988 | Hodgetts | 254/361 |
| 4,854,547 | 8/1989 | Oliphant | 254/361 |
| 4,921,219 | 5/1990 | Ottemann et al. | 254/291 |

*Primary Examiner*—Katherine Matecki

[57] ABSTRACT

A hydraulically powered, direct drive, quick response, bidirectional rotation, and variable speed and torque wireline multiple reel assembly for winding or unwinding cable under the control of an operator. A frame for rotatably supporting one or more reels. Two hydraulic wheel hubs of different cubic inch displacement are coaxially mounted internally in each reel. Each wheel hub displacement may be individually selected or combined together to give the reel assembly different speed/torque characteristics. An operator panel allows control of the selection, speed and rotational direction of each reel.

12 Claims, 15 Drawing Sheets

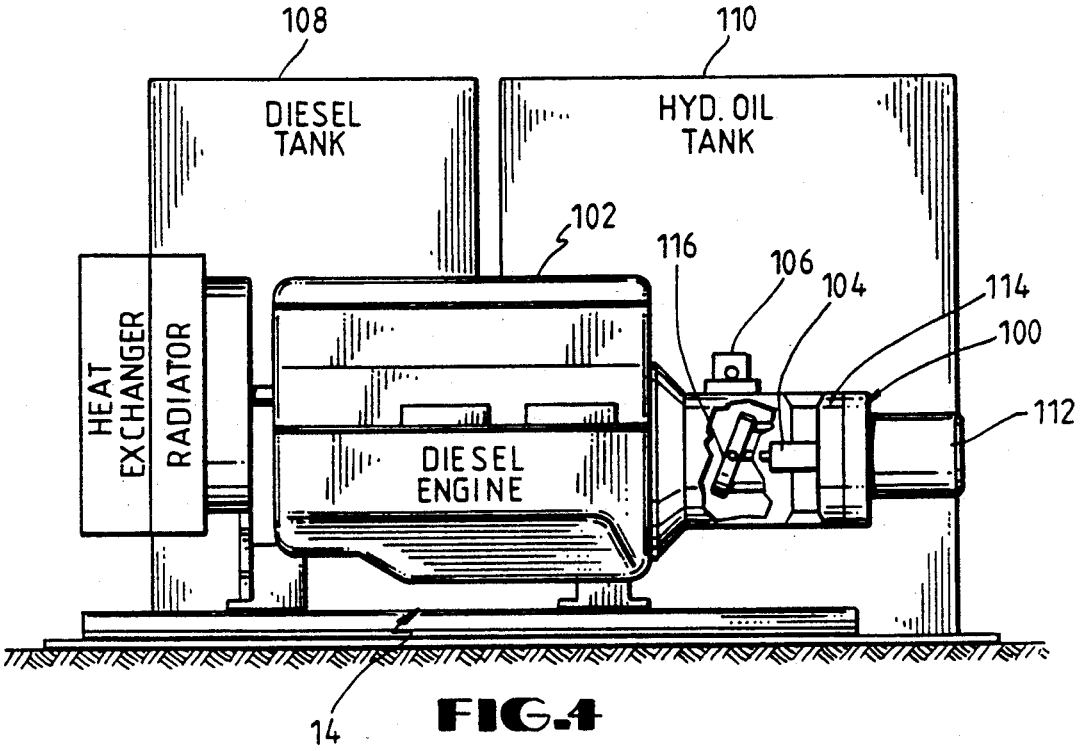
FIG.4
FIG.5
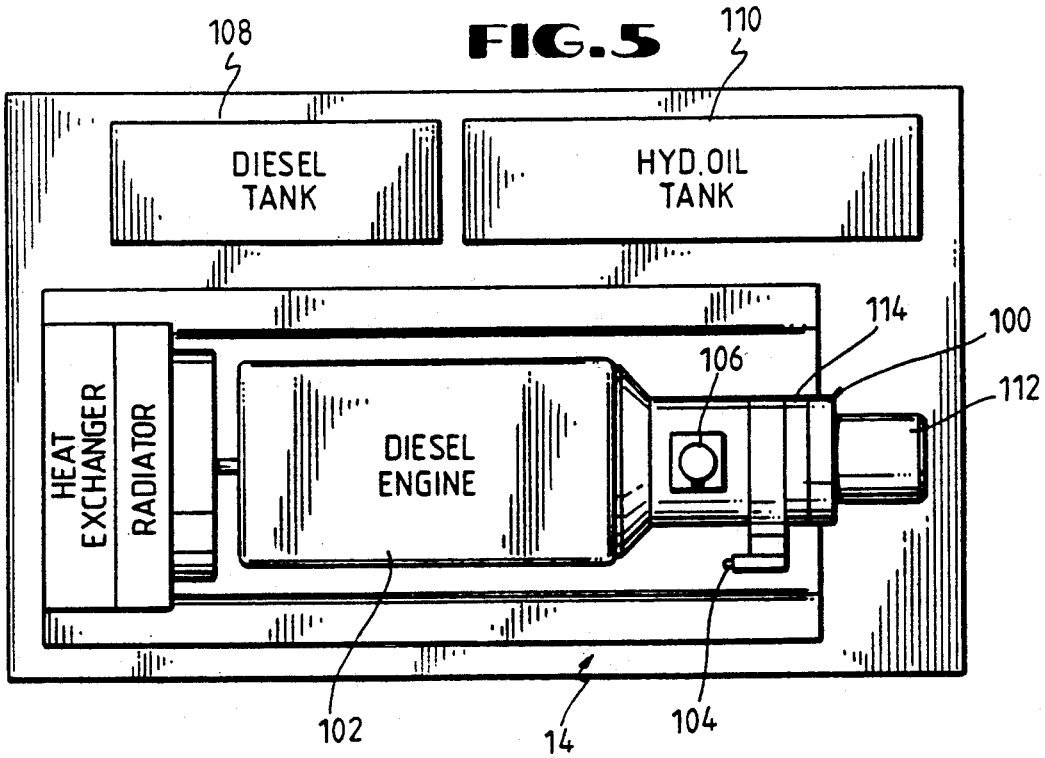

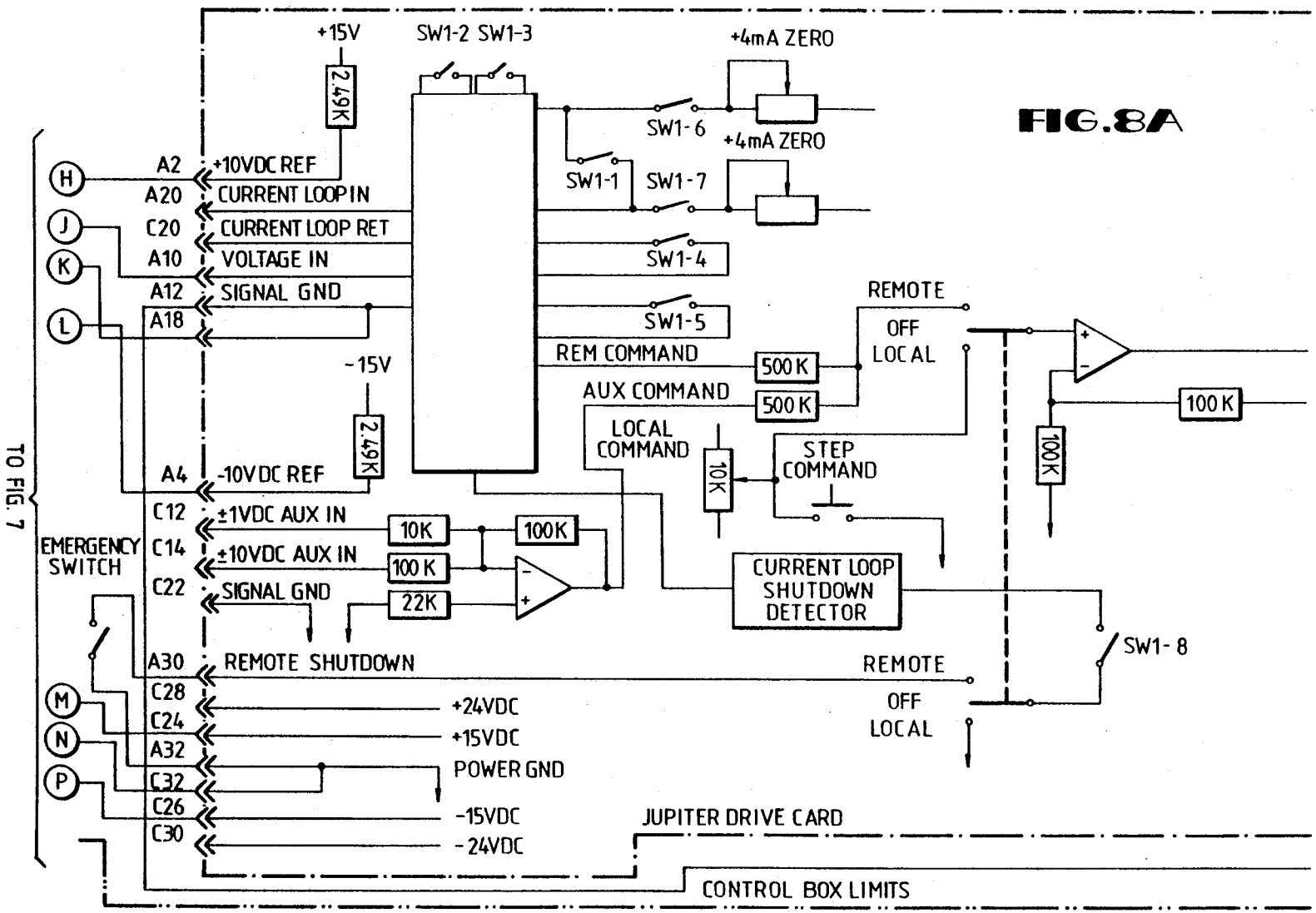
FIG. 8A
+4mA ZERO
+4mA ZERO
SW1-6
SW1-7
SW1-4
SW1-5
SW1-1
SW1-2 SW1-3
+15V
2.49K
-15V
2.49K
+10VDC REF
CURRENT LOOP IN
CURRENT LOOP RET
VOLTAGE IN
SIGNAL GND
-10VDC REF
±1VDC AUX IN
±10VDC AUX IN
SIGNAL GND
REMOTE SHUTDOWN
A2
A20
C20
A10
A12
A18
A4
C12
C14
C22
A30
C28
C24
A32
C32
C26
C30
H
J
K
L
M
N
P
EMERGENCY SWITCH
REM COMMAND
AUX COMMAND
LOCAL COMMAND
500K
500K
10K
100K
10K
100K
22K
100K
100K
REMOTE
OFF
LOCAL
STEP COMMAND
CURRENT LOOP SHUTDOWN DETECTOR
SW1-8
REMOTE
OFF
LOCAL
+24VDC
+15VDC
POWER GND
-15VDC
-24VDC
JUPITER DRIVE CARD
CONTROL BOX LIMITS
TO FIG. 7

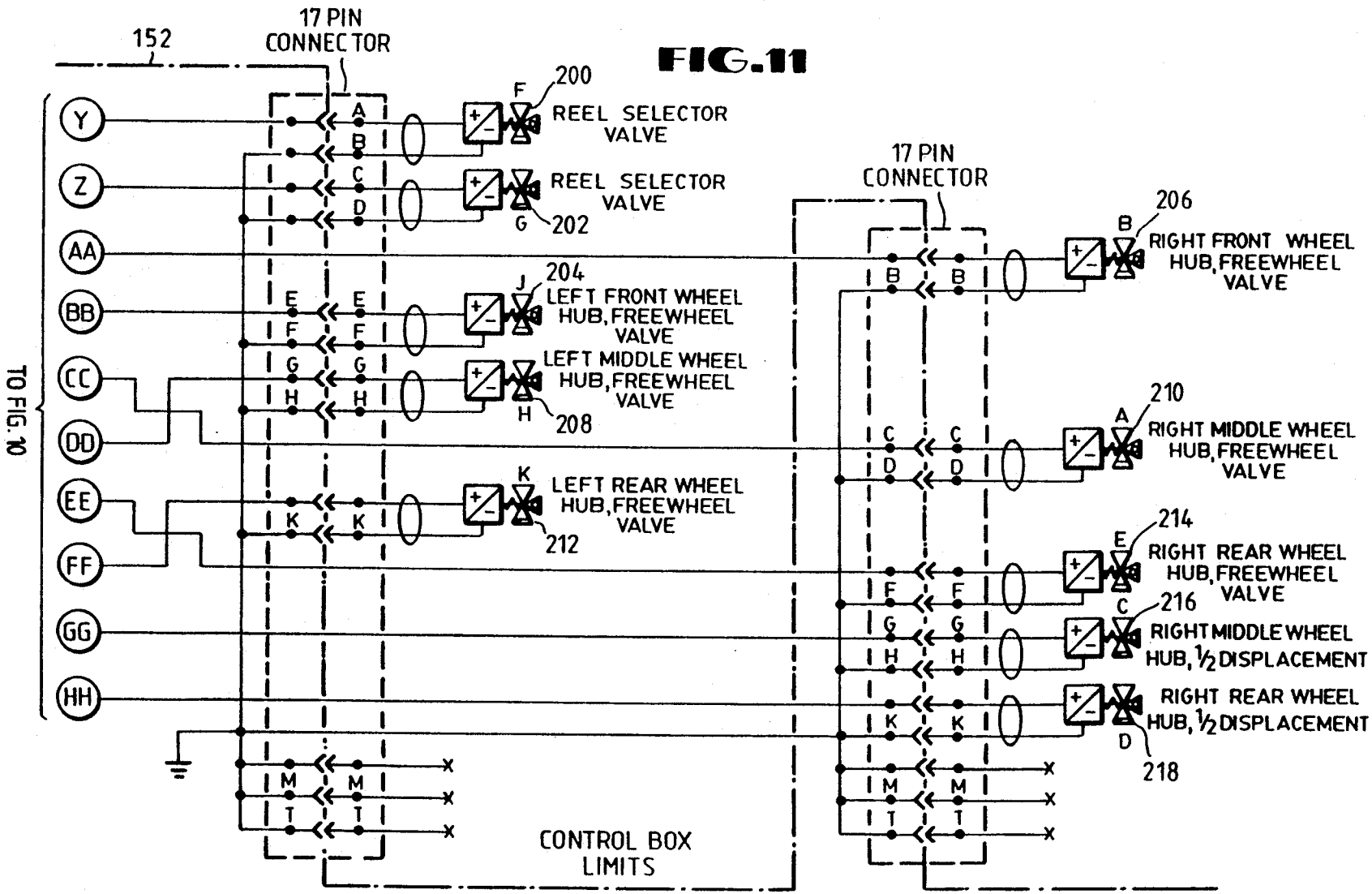
FIG. 11
REEL SELECTOR VALVE
200
REEL SELECTOR VALVE
202
LEFT FRONT WHEEL HUB, FREEWHEEL VALVE
204
LEFT MIDDLE WHEEL HUB, FREEWHEEL VALVE
208
LEFT REAR WHEEL HUB, FREEWHEEL VALVE
212
RIGHT FRONT WHEEL HUB, FREEWHEEL VALVE
206
RIGHT MIDDLE WHEEL HUB, FREEWHEEL VALVE
210
RIGHT REAR WHEEL HUB, FREEWHEEL VALVE
214
RIGHT MIDDLE WHEEL HUB, 1/2 DISPLACEMENT
216
RIGHT REAR WHEEL HUB, 1/2 DISPLACEMENT
218
17 PIN CONNECTOR
17 PIN CONNECTOR
152
CONTROL BOX LIMITS
Y
Z
AA
BB
CC
DD
EE
FF
GG
HH
TO FIG. 10

DIRECT DRIVE HYDRAULIC WIRELINE WINCH ASSEMBLY

BACKGROUND OF THE INVENTION

1. Field of the Invention

This invention relates to cable reel winching systems and in particular to a hydraulically operated multiple reel wireline cable and coiled tubing winching assembly for oil and/or gas wells.

2. Description of the Related Technology

Oil and gas well work over services utilize wireline procedures for performing a number of down hole operations. Some of these down hole operations involve installing, actuating, and removing various types of well equipment and removing tools. Well wireline services utilize tools connected to a long length of steel wireline necessary to reach the work area in the well. As can be appreciated, a great deal of force, acceleration, and speed may be needed to operate tools in the well.

Coiled tubing is used to control down hole valves, manifolds and other well tools. In addition, electric logging may be performed by means of wires run within the coiled tubing. Yet another operation that may be performed with coiled tubing is well cleaning, washing or swabbing by means of fluids or gases run through the tubing.

Powerful mechanical rotational means such as diesel engine driven wireline reels have been used to achieve the necessary pulling force. Both powerful torque and jarring actions are required of a wireline reel system. The wireline service industry usually achieves the required reel system brute force by various methods of gears, drive couplings, chains, sprockets, levers, dog clutches, etc. connected to a large horsepower prime mover such as a diesel engine.

Present wireline and coiled tubing reel systems utilize reels driven by externally mounted combinations of hydraulic or electric motors which in turn derive their power from a prime mover such as a diesel engine-generator. At best the present wireline and coiled tubing systems are large, bulky and noisy. These wireline systems are difficult to maintain and operate. Operator fatigue is a problem due to high noise levels associated with the operation of presently available wireline equipment and its complex setup and control at the well site.

SUMMARY OF THE INVENTION

In contrast to the prior wireline and coiled tubing systems, the present invention is designed primarily to eliminate or reduce excessive noise, minimize difficulty in setup and operation, improve operator convenience, reduce size, and reduce the complexity and maintenance requirements of the wireline reel assembly. The operator must work in a confined area, usually in an operator cabin, and he spends long hours on a day to day basis doing the work required. The present invention has improved reliability and longer operating time through the use of fewer components than prior wireline and coiled tubing delivery systems.

The present invention is directed to cable and coiled tubing reel winching systems that are hydraulically powered, bidirectional rotation, variable speed, operator controlled reel assemblies. The invention has a frame and at least one reel is rotatably attached between the frame. The invention uses one set of hydraulic wheel hubs for each reel. A set of hydraulic wheel hubs comprises two wheel hubs each with a different cubic inch displacement, and each with a rotating and non-rotating member. The set of two hydraulic wheel hubs, each having different cubic inch displacement, are mounted coaxially within a reel having two ends. Each rotating member of the wheel hub set are fixedly attached in one reel end respectively. Each non-rotating member of the wheel hub set are fixedly attached to the frame.

Thus, each reel is rotatably attached to the frame by means of the structure of the hydraulic wheel hubs. The reel encloses its respective wheel hub set resulting in a more compact reel assembly design having lower operating noise level and fewer moving parts. This is achieved without the conventional use of sprockets, chains, and gear drives with their inherent noisy operation and slow response time. All hydraulic fluid valving may be contained on the frame in concert with the design objective of compact size and reduced maintenance.

The wheel hub set is comprised of two different cubic inch displacement hydraulic wheel hubs so that at least three fixed speed-torque transmission ranges may be utilized with the continuously variable hydraulic fluid flow from the variable rate hydraulic pump. The system of the present invention uses remotely controlled valves that may be opened to allow hydraulic fluid to flow at a variable rate through each respective wheel hub. The hydraulic wheel hub with the largest cubic inch displacement has the greatest torque available while rotating at the slowest speed for a given flow rate. Thus, the highest rotational speed (lowest torque) is obtained from the smallest cubic inch displacement wheel hub. A preferred embodiment of the invention also has means for halving the cubic inch displacement of either of the two wheel hubs and consequently allowing an additional rotational speed.

Greater cubic inch displacement means greater torque and slower speed. Thus, when both wheel hubs are receiving fluid flow the system of the invention has its greatest torque and slowest speed. When only the larger displacement wheel hub receives fluid flow the system of the invention runs in second gear. Likewise, when only the smaller displacement wheel hub receives fluid flow the system of the invention runs in third gear. When so equipped, the half displacement mode of the wheel hub creates a smaller displacement wheel hub resulting in a fourth gear.

All fixed speed-torque changes are accomplished with remotely controlled valves that either allow hydraulic fluid flow to each wheel hub or cut off pump fluid flow. However, the valves in a preferred embodiment of the system of the invention allow a small amount of fluid to circulate in a disconnected wheel hub so that cavitation does not occur. Prevention of cavitation in the disconnected wheel hubs by circulating a small amount of fluid through the closed valves is called "free wheeling". Free wheeling also may allow the wireline cable or coiled tubing to move down hole by gravity without external power use.

The variable speed-torque and direction of rotation of a reel is accomplished in the system of the invention by a variable displacement hydraulic pump whose displacement and fluid flow direction may be controlled remotely. This variable displacement pump uses a swash plate that tilts forward and backward from a neutral vertical position.

When the swash plate is in its neutral vertical position the pump has zero displacement thus no fluid flow. When the swash plate tilts, for illustration forward, pump displacement increases and fluid flows in the forward direction. Likewise, when the swash plate tilts in the reverse (backward) direction, fluid flows in the reverse direction. Variable displacement and flow direction control are accomplished by the swash plate controlling the stroke length of the pump pistons and their stroke position timing in relation to the inlet and outlet ports of the pump.

A prime mover diesel engine may be used in the system of the present invention to rotatably drive the variable rate hydraulic pump. Different engine RPM speed values may be used with different hydraulic wheel hub engagement schedules according to predefined valve selection. The system of the present invention may have more than one reel integrally mounted on the frame. In a preferred embodiment of the present invention, three such reel/wheel hub sets are rotatably attached and integral to the system of invention's frame. The system of the present invention may remotely select one reel at a time for use by the operator. Thus, three different reels, having different operating characteristics and holding different types of wireline, may be integrally arranged on a common frame and selected by the operator.

The system of the present invention may use an operator control panel wherein all features of the invention may be utilized. The operator control panel may contain, but is not limited to, reel selection, selected reel hydraulic wheel hub set combination (gear selection), emergency system shutdown, and speed and direction control joystick. All of the above controls have been previously described except for the speed and direction control joystick. The joystick is used to control the position of the swash plate of the variable displacement pump. As previously described, the swash plate controls the hydraulic fluid flow rate and direction. Thus, the joystick controls the speed and rotation of the selected reel in either a clockwise or counter-clockwise direction.

The system of the invention uses a closed loop, fast response control system for translating the position of the operator control panel joystick to a corresponding swash plate position. Rapid and precise tracking of the joystick position by the swash plate is accomplished by use of an electronic closed loop controller. This controller uses the position information from the joystick, and the swash plate position derived from a position indicating potentiometer directly connected to the swash plate. The electronic loop controller compares the joystick and swash plate positions and if there is sufficient difference between the two position inputs then the controller output will drive an electrically actuated pump coil which changes the position of the swash plate to more closely conform to the position of the joystick. The loop controller may change the position of the swash plate in no more than 100 milliseconds after the joystick position is changed by the operator.

An object of the present invention is an operator controlled, hydraulically powered, bidirectional rotation, variable speed, reel assembly for winching wireline cables.

A further object of the present invention is the use of two hydraulic wheel hubs, each having different displacement, integrally mounted within a reel, for selection of different fixed speed-torque characteristics.

Yet a further object of the present invention is the use of a means for displacement reduction of the wheel hubs so as to obtain additional gears or overdrive capability in a reel with two wheel hubs so equipped.

Still a further object of the present invention is the use of an operator controlled joystick to continuously control a variable displacement hydraulic pump with reversible flow direction so as to vary the speed-torque and direction of rotation of a hydraulically driven wireline reel.

A further object of the present invention is mounting of multiple reels on a common frame, wherein an operator may select, from a control panel, operation of an individual reel.

Yet a further object of the present invention is the use of a pneumatic breaking means for slowing or stopping the rotation of a reel.

A further object of the present invention is control of reel selection, speed-torque, direction of rotation and braking of the operating reel from a remote control panel located in the operator's work area.

A further object of the present invention is mounting a multiple reel assembly on a skid.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 4 is an elevational view of a preferred embodiment of the diesel engine driven variable displacement hydraulic pump assembly, FIG. 5 is a top view of a preferred embodiment of the diesel engine driven variable displacement hydraulic pump assembly, FIGS. 7, 8A, 8B, 9, 10 and 11 are continuations of each other and form an electrical schematic block diagram of a preferred embodiment of the system of the invention.

DETAILED DESCRIPTION OF THE PREFERRED EMBODIMENT

Figure 1:
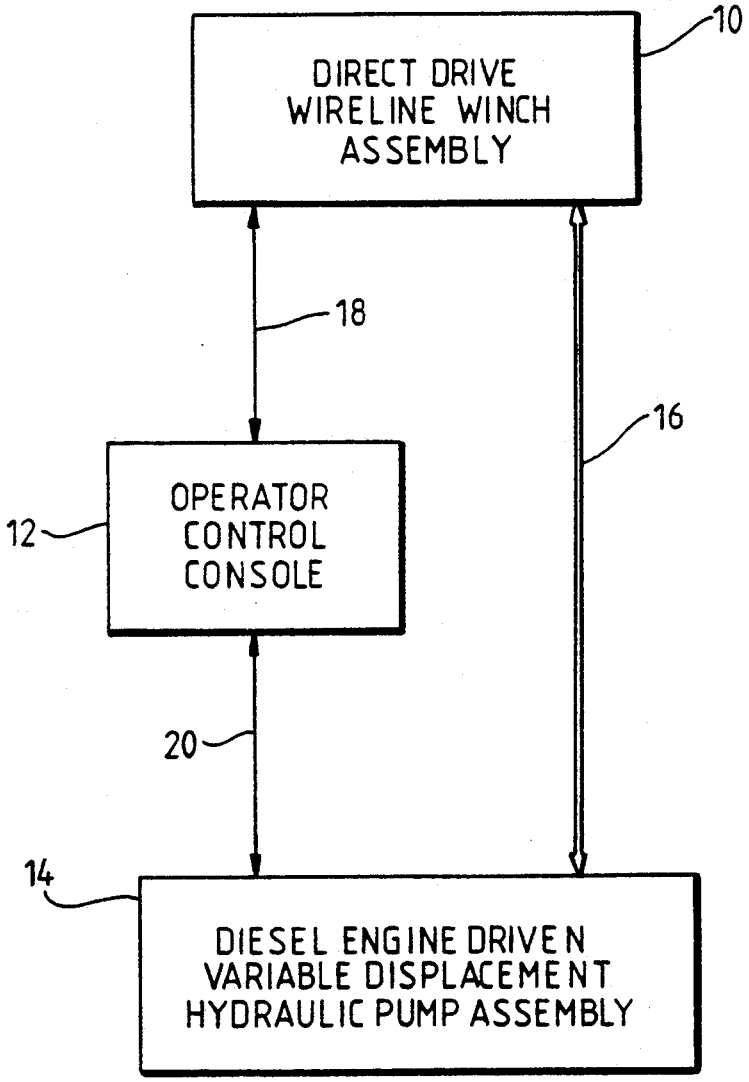
FIG. 1 is a schematic block diagram of an embodiment of the system of the present invention.

Referring now to the drawings, and particularly to FIG. 1, the reference S generally indicates a block diagram of the system of the present invention. The system of the present invention comprises a wireline reel assembly 10, an operator control panel 12, a diesel engine driven variable displacement hydraulic pump assembly 14, hydraulic fluid conductors 16, electrical instrumentation and control wires 18, and electrical instrumentation and control wires 20. The wireline reel assembly comprises, but is not limited to, at least one wireline reel, at least one set of hydraulic wheel hubs, control valves, and other devices as will be more fully described.

The engine-pump assembly 14 comprises a diesel engine prime mover of sufficient horsepower capacity to meet the requirements of the system of the invention, a variable displacement and flow direction controllable hydraulic pump, various fluid tanks, valves and piping as will be more fully described.

The operator control console 12 comprises controls for the operator to run the system of the invention from an operating position advantageous to the wireline work being performed. The operator panel 12 is in communication with control and monitoring systems in the reel assembly 10 by means of electrical cables 18. In similar fashion, the panel 12 is in communication with engine-pump 14 by means of electrical cables 20. Fluid conductors 16 allow passage of hydraulic fluid power to the reel assembly 10 and for return of used power fluid back to engine-pump 14 in a closed loop hydraulic system.

Figure 2:
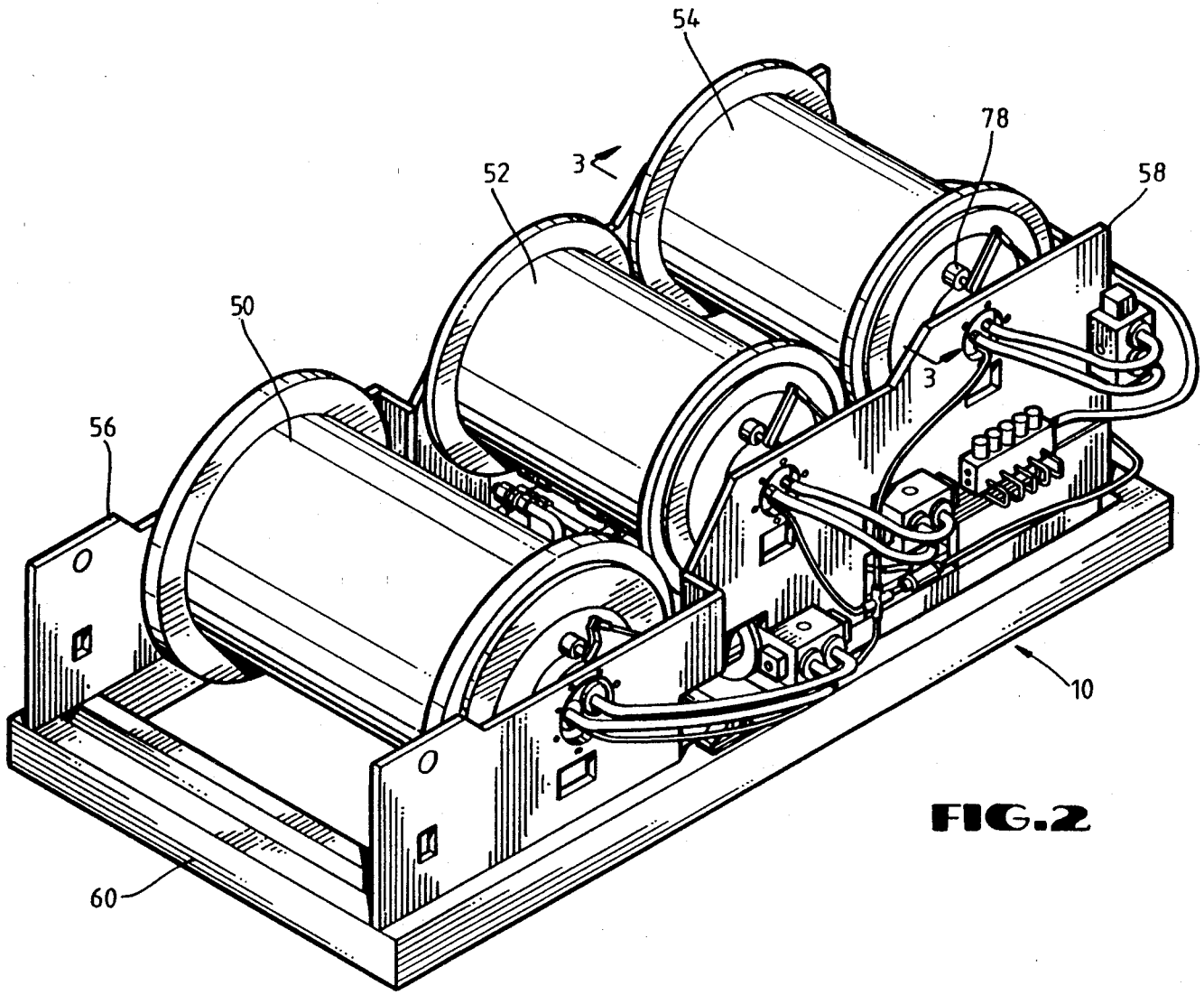
FIG. 2 is an orthogonal view of a preferred embodiment of the wireline reel assembly.

As best seen in FIG. 2, reel assembly 10 may comprise three direct drive reels 50, 52 and 54 rotatably attached between vertical side plates 56 and 58. The vertical side plates 56 and 58 are fixedly attached to a horizontal base 60 forming a support frame for the reels and associated valves for control of wheel hubs coaxially mounted within the reels.

Figure 3:
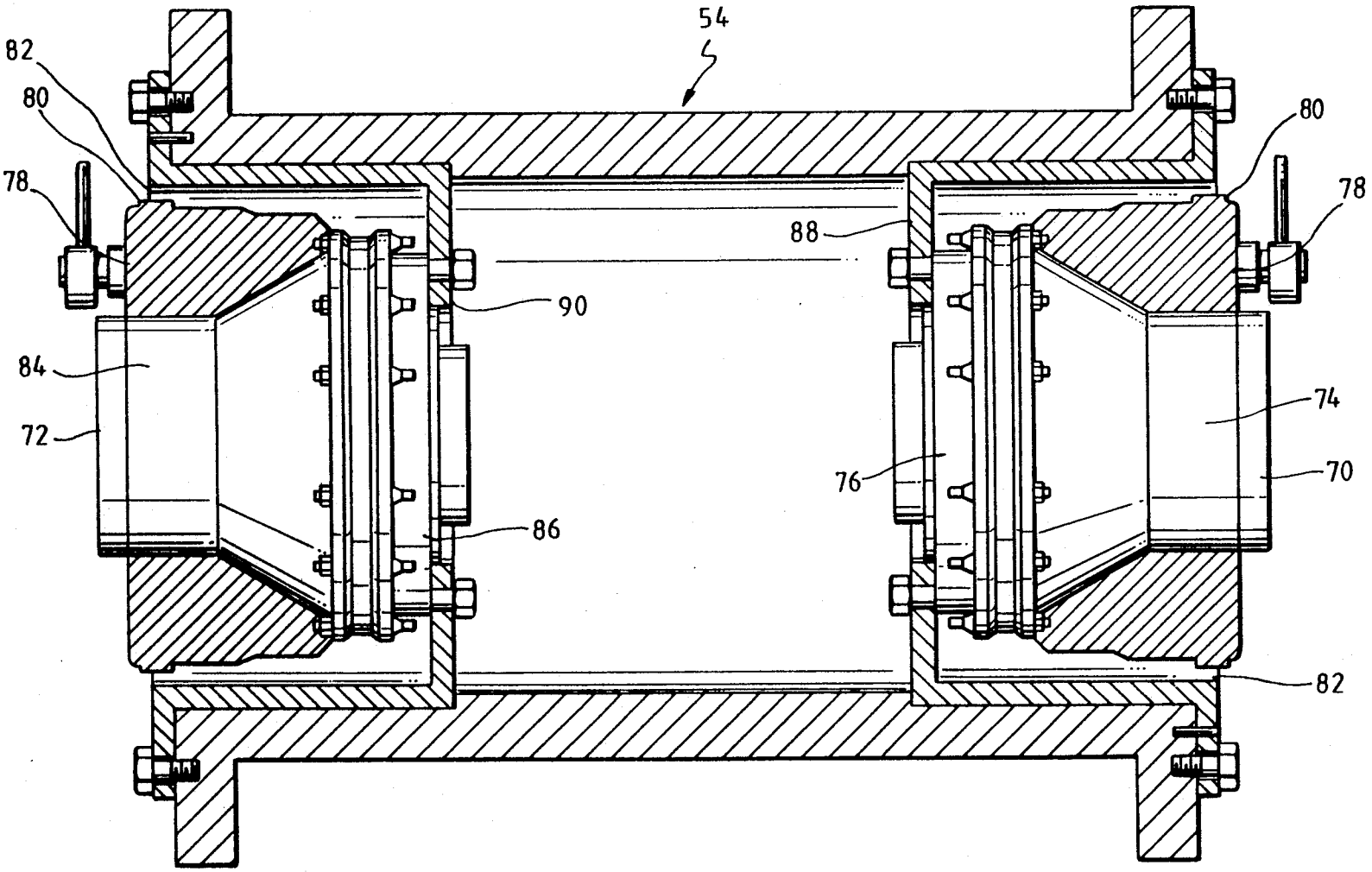
FIG. 3 is a view taken along the line 3—3 of FIG. 2.

Referring now to FIG. 3, the reel 54 is illustrated in cross sectional view where wheel hubs 70 and 72 are internally mounted coaxially inside and at opposite ends of the reel 54. The wheel hubs 70 and 72 are each comprised of a fixed member 74 and a rotating member 76. Reels 50 and 52 are similarly constructed with their own integral wheel hubs.

The wheel hubs 70 and 72 are coaxially enclosed inside of the reel 54. A pneumatically controlled brake 78 is fixedly mounted to each wheel hub fixed member 74 and 84. The brake 78 slows or stops rotation of the reel 54 by extending its friction shoe 80 against an inner surface 82 of the reel 54. The reel 54 is rotatably attached to the side plates 56 and 58 by fixedly attaching the wheel hub fixed members 74 and 84 to the side plates 56 and 58, respectively, and fixedly attaching the wheel hub rotating members 76 and 86 to U-shaped brackets 88 and 90, respectively. The U-shaped brackets 88 and 90 are fixedly attached to the inside of the reel 54.

An advantage of the present invention is the integral internal mounting of the wheel hubs 70 and 72 coaxially within the reel 54 and between side plates 56 and 58 respectively. All necessary mechanical driving force for rotation of the reel 54 is provided by the wheel hubs 70 and 72. This new and novel configuration allows reduced equipment size, lower operating noise, less maintenance, and quicker response. The reels 50 and 52 are of similar construction to the reel 54 described above. Wheel hubs may be commercially available units such as Valmet Black Bruin (Class 1–6).

The wheel hub 70, for example, has a larger cubic inch displacement than has the wheel hub 72. A small cubic inch displacement means high rotational speed and low torque for a given hydraulic pressure and flow rate. The larger the cubic inch displacement, the larger the rotational torque available but the slower the speed for a given hydraulic pressure and flow rate. Thus, a preferred embodiment of the present invention may use, for example, 97 and 61 cubic inch displacement wheel hubs in reel 50, and 48 and 38 inch displacement wheel hubs in reels 52 and 54. An additional preferred embodiment of the present invention uses wheel hubs whose displacement may be halved.

Having the capability of remotely selecting two wheel hubs of different displacement, and full or half displacement control of each of the wheel hubs allows at least four fixed torque-speed selection ranges. When both of the wheel hubs 70 and 72 are active and connected to the hydraulic power source, maximum displacement is engaged and maximum system torque is achieved. This condition is analogous to first gear. When only the larger displacement wheel hub 70 is engaged, the system of the invention is in second gear. Likewise, when only the smaller displacement wheel hub 72 is engaged, the system is in third gear. The equivalent of fourth gear or overdrive is achieved when only wheel hub 70 is engaged at half of its displacement.

Referring now to FIGS. 4 and 5, the diesel engine driven variable displacement hydraulic pump assembly 14 comprises a variable displacement hydraulic pump 100 rotatably driven by prime mover diesel engine 102, a pump coil servo input 104 for remote control positioning of a swash plate 116, a position potentiometer 106 indicating the position of the swash plate 116, a fuel tank 108 for storing the engine 102 fuel, a hydraulic fluid storage tank 110, an auxiliary pump 112, and a charge pump 114. The hydraulic fluid tank 110 is used to store hydraulic oil for use during operation of the system of the invention. The auxiliary pump 112 may be used in the hydraulic control system and as reserve/support hydraulics to ensure a constant volume and pressure of hydraulic fluid in the main power loop. The charge pump 114 may replenish lost primary power fluid to the closed loop hydraulic power circuit. The variable displacement pump 100 may be a model P6P commercially manufactured by Hagglunds Denison.

The variable displacement of the pump 100 is remotely controlled by means of the servo input 104 which is an electric coil actuator and hydraulic servo pilot. The servo input 104 controls the swash plate 116 internal to the pump 100 which may vary the displacement of the pump and may change the direction of fluid flow. Varying the displacement of the pump 100 is accomplished by the swash plate 116 changing the amount of stroke travel of pistons internal to the pump 100. Direction of fluid flow, in relation to the inlet and outlet ports, may be reversed by the swash plate, 116 changing the stroke timing of the pistons. The position potentiometer 106 furnishes swash plate position information in electrical form for use by the control panel loop controller 220 ( FIG. 6).

Figure 6:
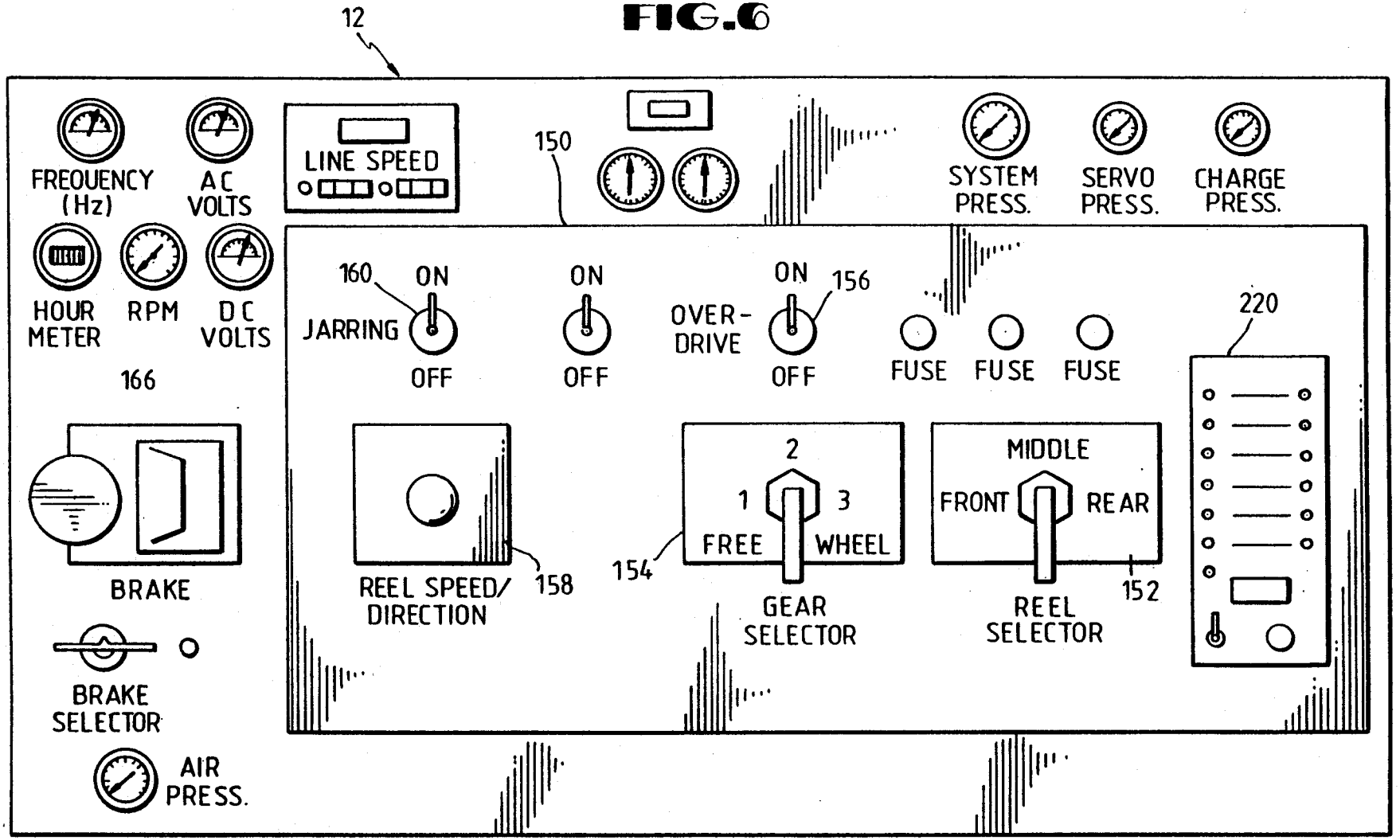
FIG. 6 is a front view of a preferred embodiment of an operator control panel.

Referring now to FIG. 6, an operator control panel 150 comprises reel select switch 152, gear select switch 154, overdrive switch 156, joystick speed/direction control 158, jarring switch 160, and pneumatic brake lever 166. In addition there is a gauge panel that indicates, but is not limited to, pressures for the primary hydraulic system, charge pump and replenishment oil. The control panel 150 and associated gauge panel allow the wireline service operator to control and monitor all functions necessary to perform the wireline or coiled tubing job required at the well site.

Figure 10:
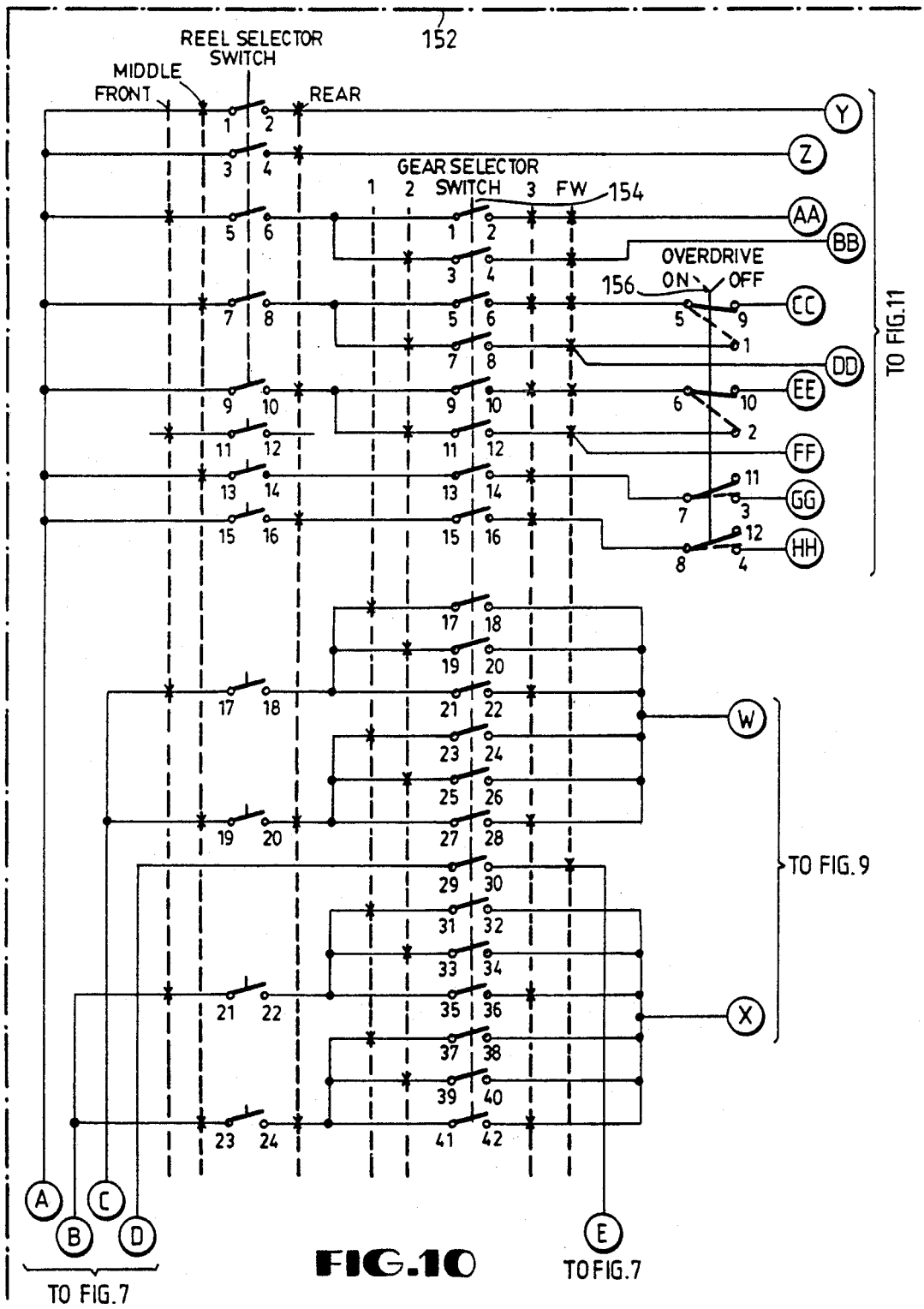

The reel select switch 152, as illustrated in FIGS. 6 and 10, selects operation of one of the three reels 50, 52 or 54 by enabling hydraulic fluid flow to the selected reel by means of an electrically operated solenoid pilot valve controlling a hydraulically switched control valve. The gear select switch 154, as illustrated in FIGS. 6 and 10, selects three different torque-speed ranges and allows free wheeling of the operational reel, for example the reel 54, by allowing fluid flow to both wheel hubs 70 and 72, to wheel hub 70 only, to wheel hub 72 only, or to neither wheel hub respectively. The overdrive switch 156, as illustrated in FIGS. 6 and 10, engages the half displacement option in one of the active wheel hubs.

Figure 9:
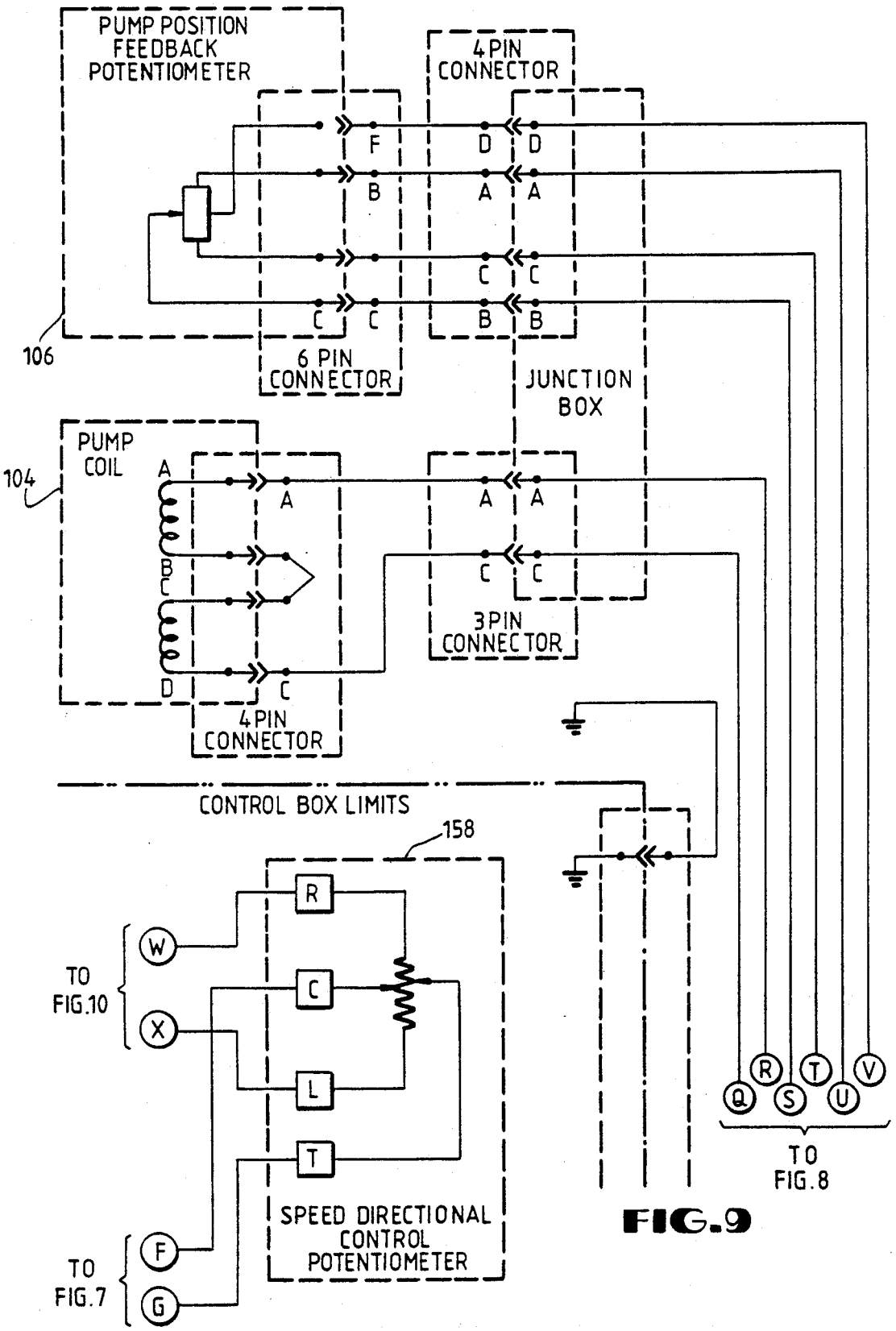

The reel speed/direction joystick 158, as illustrated in FIGS. 6 and 9, controls the position of the swash plate 116 located within the pump 100. The joystick 158 is an electrical potentiometer that transmits a reference signal to a first input of a high speed, not more than 100 millisecond response, closed loop controller 220. The loop controller 220 drives the pump servo input 104 which moves the position of the swash plate. The position indicator 106 transmits a reference signal, indicating actual swash plate position, to a second input of the loop controller 220. The loop controller 220 attempts to match the position of the swash plate 116, indicated by position indicator 106, with the position of the joystick 158 by an output control voltage transmitted to pump coil 104. Any deviation between the joystick 158 and the swash plate positions creates an error signal in the loop controller 220 electronics causing a compensating signal output to the pump coil servo input 104.

Figure 13:
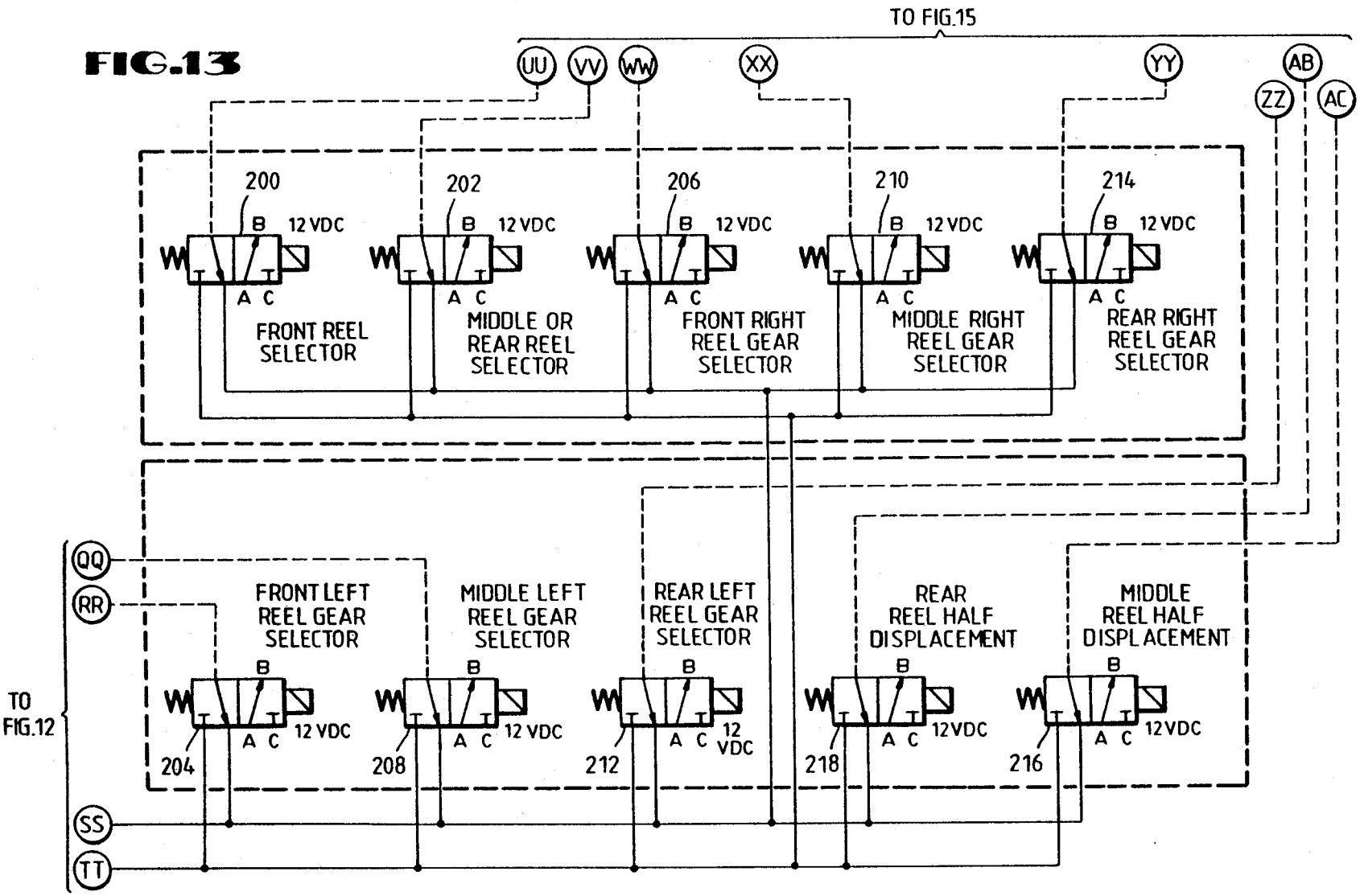

Referring now to FIGS. 7, 8A, 8B, 9 and 10 and 11, with reference back to FIGS. 2, 4 and 5, the reel selector switch 152 selects operation of one of the front reel 50, middle reel 52, or rear reel 54 by applying 12 volt direct current ("VDC") from a DC power source 222, such as a diesel engine or truck battery, to the electrical solenoid actuators of first and/or second reel selector pilot valves 200 and 202 (FIGS. 11 and 13) respectively. The reel selector switch 152 uses a binary combination of the pilot valves 200 and 202 in the selection of the desired reel. The front reel 50 is selected when valve 314 (FIG. 14) is deactivated by its pilot valve 200 (FIG. 13). The middle reel 52 is selected when valve 314 is activated by pilot valve 200 and valve 316 (FIG. 15) is deactivated by its pilot valve 202. The rear reel 54 is selected when both valves 314 and 316 (FIGS. 14 and 15) are activated by pilot valves 200 and 202 (FIG. 13), respectively.

Gear selector switch 154 controls the appropriate valves to engage or disengage each of the wheel hub sets of the three reels. For example, when the front reel 50 is in operation, the equivalent of first gear is obtained when both left and right wheel hubs receive hydraulic fluid power. This is achieved when both of the valves 318 and 320 (FIG. 14) allow hydraulic fluid to flow through wheel hubs 350 and 354, respectively. The valves 318 and 320 are controlled by the pilot valves 204 and 206 (FIGS. 11 and 13) respectively. Disengaging a wheel hub requires the system of the invention to energize the respective wheel hub pilot valve which opens it and activates its respective control valve which, in turn, disconnects the wheel hub from the hydraulic power source. When a wheel hub pilot valve is energized its respective wheel hub will free wheel.

As illustrated in FIGS. 10, 11, 13 and 14, first gear for the front reel 50 is obtained when both pilot valves 204 and 206 are de-energized, second gear is obtained by energizing pilot valve 204, third gear is obtained by energizing pilot valve 206, and free wheeling of the reel 50 is obtained when pilot valves 204 and 206 are both energized. In a similar fashion, pilot valves 208 and 210 control the operation of the middle reel 52 and pilot valves 212 and 214 control the operation of the rear reel 54.

The overdrive select switch 156 (FIGS. 6 and 10) controls the half displacement option in the wheel hubs so equipped. As illustrated in FIGS. 10, 11, 13, 14 and 15, overdrive for the middle reel 52 is obtained by de-energizing pilot valve 210, energizing pilot valve 208, and energizing half displacement pilot valve 216. The overdrive feature is normally available only when third gear is selected. In similar fashion, overdrive for the rear reel 54 is obtained by de-energizing pilot valve 214, energizing pilot valve 212, and energizing half displacement pilot valve 218.

Now referring to FIG. 9, the reel speed/direction joystick 158 (FIG. 6 and 9) controls the rotational speed and direction of the selected reel. The joystick 158 performs this feature by remotely controlling the position of the swash plate 116 in the pump 100. As illustrated in FIGS. 8 and 9, control of the pump 100 swash plate position is accomplished by means of the closed loop controller 220 receiving a first input position from joystick 158 and a second input position from pump swash plate position indicator 106, then transmitting a position control signal to pump coil servo input 104.

In operation, moving the joystick 158 forward from its neutral position, away from the operator, causes the reel to unwind wireline down into the well. Moving the joystick 158 backward from its neutral position, toward the operator, causes the reel to wind the wireline, bringing up the well tool. An operation called "jarring" is performed when a well tool is set, activated, deactivated, stuck, or being removed. Jarring normally requires that some tension be maintained on the wireline so as not to cause a "birds nest" jumble of cable on the wireline reel.

As illustrated in FIGS. 6, 7, 8A, 8B, and 9, a jarring switch 160 disables the joystick 158 unwind command that normally would be transmitted to the first input of the loop controller 220. Thus, preventing the operator from accidentally unwinding the wireline in tension.

The loop controller 220 compares the electrical input signals from the joystick 158 position potentiometer with the pump 100 swash plate position indicator 106 potentiometer. When there is a difference between the joystick 158 and the swash plate indicator 106 position signals, an error voltage is created in the loop controller 220. This error voltage causes the loop controller 220 to generate an electrical output signal which is transmitted to the pump coil servo input 104, for the purpose of moving the swash plate 116 in a direction that reduces the above mentioned error voltage. The loop controller 220 may be a Jupiter Drive Card electronic module manufactured by Hagglunds Denison Corp.

Figure 7:
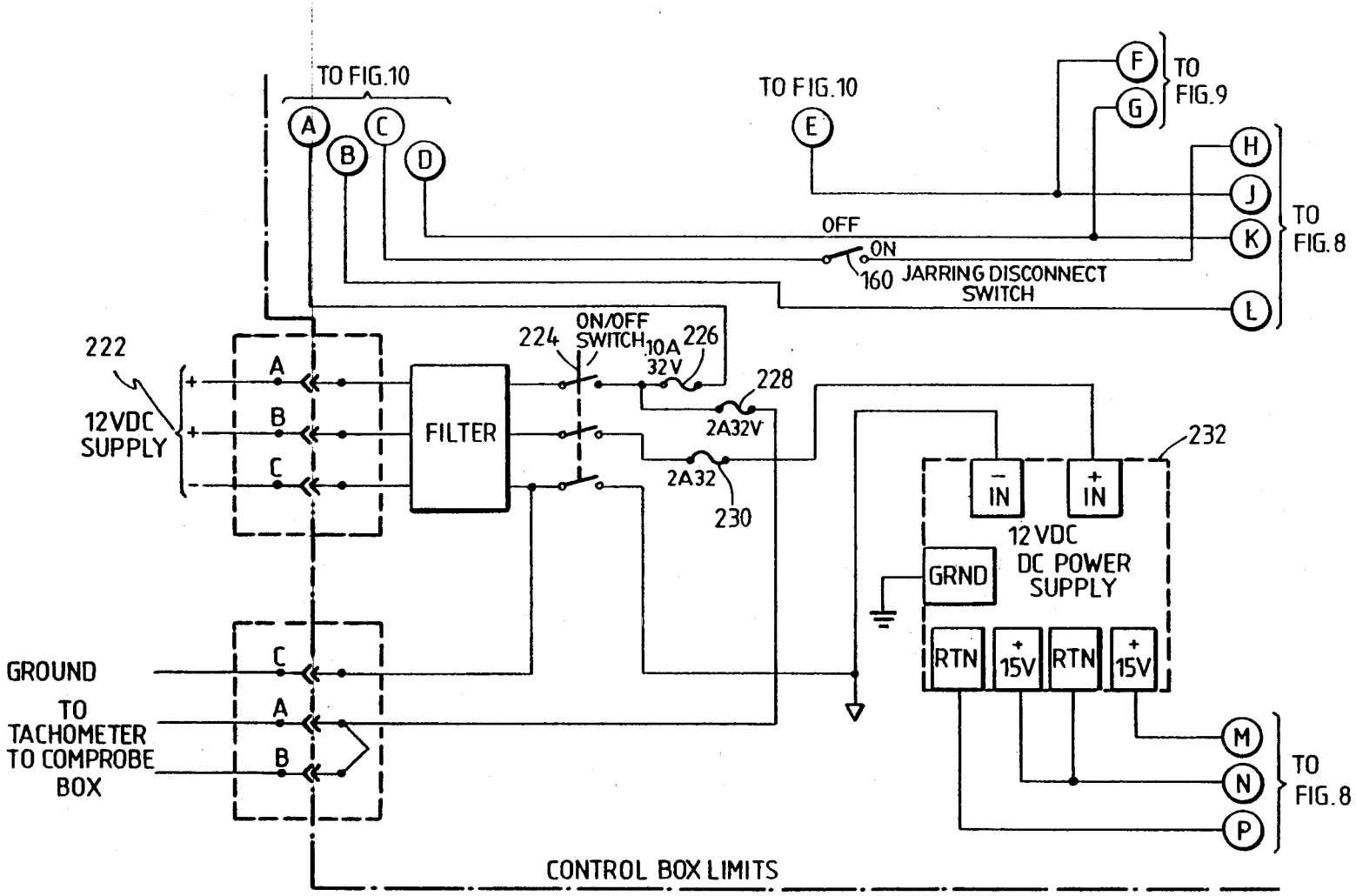
Figure 8B:
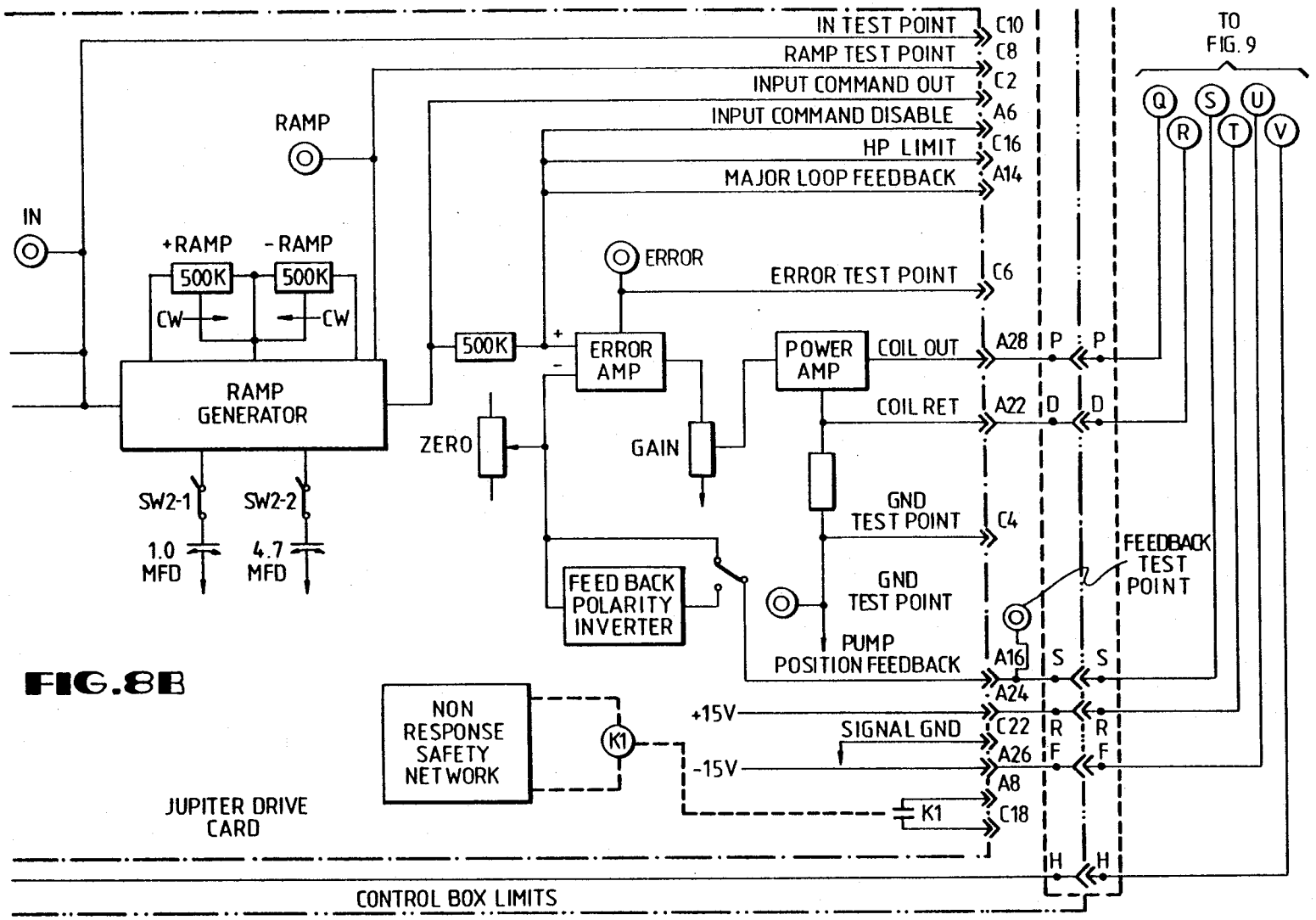

As illustrated in FIG. 7, DC voltage for the system of the invention may be obtained from a DC power source 222, for example, the diesel engine battery. 12 VDC supply source 222 connects to switch 224 which further connects to distribution fuses 226, 228 and 230. The fuse 230 connects to DC power supply 232. The DC power supply 232 produces filtered and regulated plus and minus 15 volts DC to power the loop controller 220.

Figure 12:
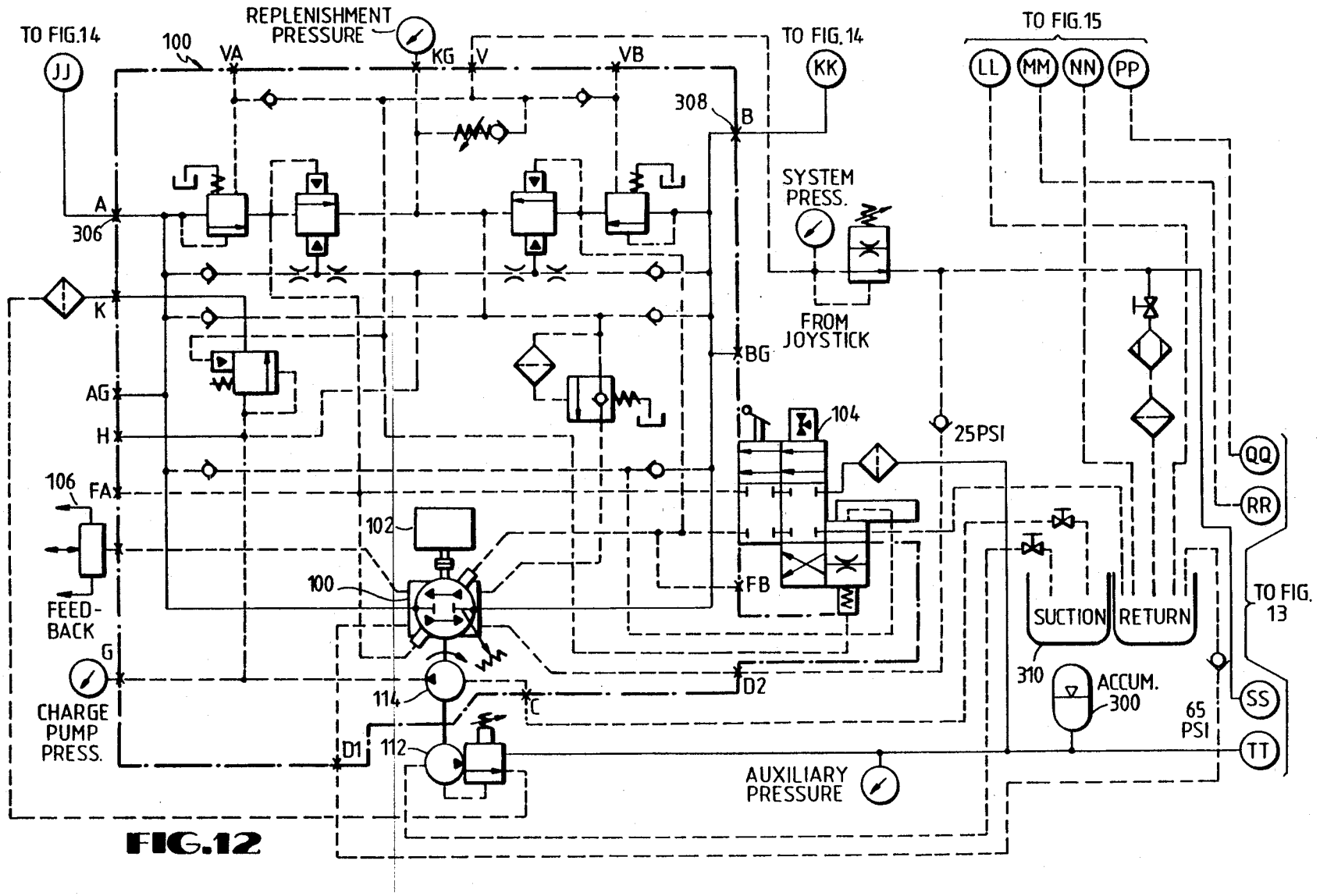
FIGS. 12, 13, 14 and 15 are continuations of each other and form a hydraulic schematic block diagram of a preferred embodiment of the system of the invention.

Referring now to FIG. 12, the pump 100 comprises a swash plate position controlled variable displacement piston design that uses a charge pump 114 to replenish and maintain main loop hydraulic fluid and an auxiliary pump 112 to pressurize control fluid. The pump 100 may be a High IQ Control variable displacement pump manufactured by Hagglunds Denison Corp.

The charge pump 114 initially pressurizes the hydraulic system of the invention from fluid stored in suction sump 310. In addition, the charge pump 114 may maintain main loop fluid volume by replenishing fluid lost during hot oil stripping. As soon as the variable displacement pump 100 is charged with hydraulic fluid it begins controlling the main closed loop hydraulic power circuit.

The auxiliary pump 112 maintains gravity feed filtrated suction to its integral gear chamber and supplies pressurized fluid for actuating system valves by means of pilot valves that are controlled by electrically operated solenoids. The pilot valves interface the main loop control valves to the operator control panel 150 electric control system.

The auxiliary pump 112 additionally supplies reserve support hydraulics to the main loop and the pump 100 to ensure that a constant volume and pressure be maintained in the power loop during high demand modes of operation such as acceleration and jarring. An accumulator 300 is utilized to store this reserve pressurized fluid volume. The auxiliary pump 112 provides filtered fluid flow and pressure directly back to the pump 100 as auxiliary replenishment of the primary hydraulic power loop.

As illustrated in FIG. 12, the pump 100 controls the flow rate and direction of fluid through main ports 306 and 308. Normally fluid flows out of port A 306 and returns back to port B 308, for example, during unwinding reel rotation. For winding reel rotation, just the reverse, fluid flows into port A 306 and out of port B 308. This fluid flow reversal is accomplished by means of the change in the swash plate contained within the pump 100. The swash plate position, as discussed above, is controlled by the servo input 102 and verification of the swash plate position is accomplished by the indicator 106.

Figure 14:
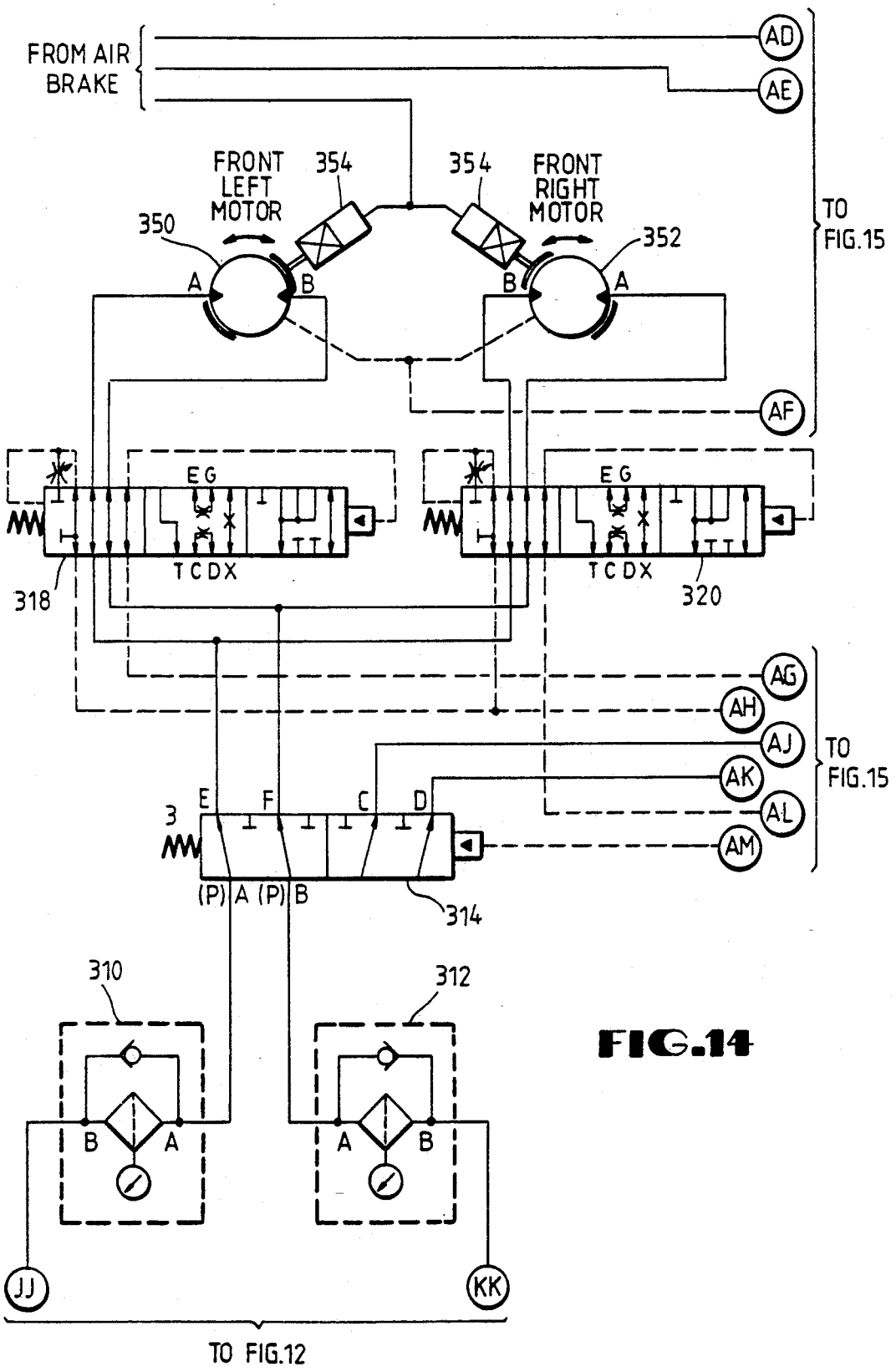

As illustrated in FIGS. 12 and 14, main power hydraulic fluid flows out of the port A 306 through a first loop filter 310 and returns back to the port B 308 through a second loop filter 312. The filters 310 and 312 prevent sediment and sludge from entering the pump 100. The filter 310 connects to and conducts hydraulic fluid to/from a first port in first reel selector valve 314. In similar fashion, the second filter 312 connects to and conducts fluid from/to a second port in the reel selector valve 314 and the port B 308.

Referring now to FIGS. 13 and 14, the reel selector valve 314 is controlled by the pilot valve 200. The valve 314 conducts main power fluid flow to/from the front reel 50 left and right wheel hub control valves 318 and 320 respectively. The valves 318 and 320 are activated by pilot valves 204 and 206 respectively. The wheel hub control valves may be Valmet Sisu Hydraulics Model F-200.

Figure 15:
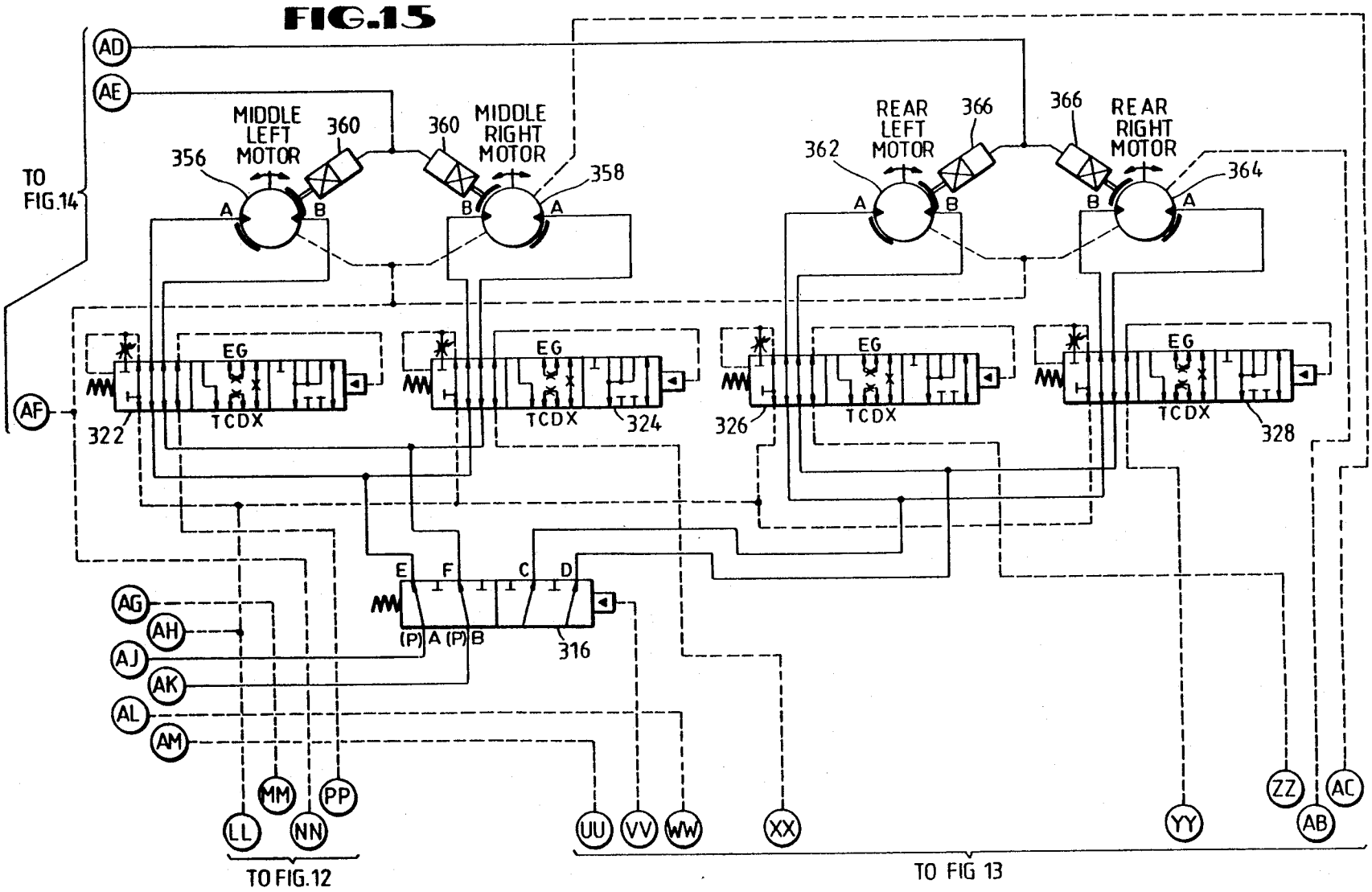

In similar fashion, as illustrated in FIGS. 13, 14 and 15, when selector valve 314 switches it conducts main power fluid flow to/from selector valve 316. The selector valve 316 directs fluid flow to/from either the middle reel 52 wheel hub control valves 322 and 324, or the rear reel 54 wheel hub control valves 326 and 328. The valves 322, 324, 326 and 328 are actuated by pilot valves 208, 210, 212 and 214 respectively. The half displacement pilot valves 216 and 218 actuate the middle reel 52 and the rear reel 54 half displacement wheel hub overdrive options respectively.

Left wheel hub 350 and right wheel hub 352 power the front reel 50. Pneumatic brake 354 slows or stops the rotation of the reel 50. Left wheel hub 356 and right wheel hub 358 power the middle reel 52. Pneumatic brake 360 slows or stops the rotation of the reel 52. Left wheel hub 362 and right wheel hub 364 power the rear reel 54. Pneumatic brake 366 slows or stops the rotation of the reel 54.

Operational breaking is normally obtained through the main power hydraulic system. However, during an emergency loss of hydraulic power the pneumatic brake may be utilized. In addition, the pneumatic brake may be used in jarring operations to build up more acceleration power before rotation commences. The pneumatic brake may also be used as a safety stop when the hydraulic system is shut down.

The functions of the above described hydraulically powered wireline reel system may be controlled by hydraulic or pneumatic control in place of the above described electric control panel, or by direct mechanical connection to control levers on a local control panel integrally mounted, for example, on a skid with the reel assembly, the variable displacement pump and its engine driver.

The system of the present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. An operator controlled, hydraulically powered, bidirectional rotation, variable speed, reel assembly for winding and unwinding oil and/or gas well wireline cable or coiled tubing, comprising, a frame;

at least one wireline reel having first and second ends;

a set of first and second hydraulic wheel hubs for each reel, each hydraulic wheel hub having a rotating and non-rotating member;

said first and second hydraulic wheel hubs being positioned coaxially within and at opposite ends of each reel respectively, wherein said wheel hub rotating members are fixedly attached to said reel and said wheel hub non-rotating members are fixedly attached to said frame whereby said reel is rotatably attached to said frame; and variable displacement bidirectional pumping means for pumping hydraulic fluid in a closed loop wherein the direction and flow rate of the pumped fluid may be operator controlled;

said closed loop including said hydraulic wheel hubs; and operator control means in the closed loop for operator control of said pumping means whereby the operator controls the rotational speed and direction of said reel.

2. The reel assembly of claim 1, further comprising operator controlled first and second valves for selectively controlling hydraulic fluid flow to said first and second hydraulic wheel hubs respectively.

3. The reel assembly of claim 2, wherein:

said first hydraulic wheel hub having a larger displacement than said second hydraulic wheel hub for providing different rotational speed and torque requirements of said reel;

said operator control means connected to and selectively controlling said first and second control valves whereby the operator selectively engages either or both hydraulic wheel hubs for obtaining three different rotational speed and torque ranges for said reel.

4. The reel assembly of claim 3, further comprising means for reducing the displacement of said first and second hydraulic wheel hubs, said reducing means connected to and operated by said operator control means for obtaining at least four rotational speed and torque ranges for said reel.

5. The reel assembly of claim 2, wherein said first and second control valves include free wheeling positions having a valve allowing the circulation of fluid in unactuated wheel hubs to prevent fluid cavitation in said hydraulic wheel hubs and allow speed changing while said reel is rotating.

6. The reel assembly of claim 1, further comprising a pneumatic reel brake for jarring operations, and independently slowing or stopping the rotation of said reel, said reel brake being controllable from said operator control means.

7. The reel assembly of claim 1, wherein said pumping means comprises:

a variable displacement multi-piston pump;

a variable position swash plate integral with said multi-piston pump, said swash plate position determining the direction and amount of fluid flow from said pump;

means for electrohydraulically controlling the position of said swash plate; and a swash plate position potentiometer, said position potentiometer connected to said swash plate for indicating position thereof.

8. The reel assembly of claim 7, wherein said operator control means comprises:

an electric coil driver, said driver electrically connected to and powering said electrohydraulic swash plate position control means;

means for closed loop servo control of said swash plate position;

a lever action potentiometer joy stick connected to said servo control means, said joy stick used by the operator to indicate the required fluid direction and flow rate to said swash plate servo control means; and said swash plate position potentiometer said joy stick and said coil driver all connected to said servo control means to function as a closed loop servo control system for the purpose of controlling and rapidly changing the position of said swash plate which controls the direction and flow rate of the hydraulic fluid to said hydraulic wheel hubs.

9. The reel assembly of claim 8, further comprising a jarring switch for maintaining cable tension, said jarring switch preventing said joystick and servo loop control means from allowing said reel to unwind the wireline cable in tension.

10. The reel assembly of claim 8, wherein said servo loop control means response time is no more than 100 milliseconds.

11. The reel assembly of claim 1, further comprising at least one operator controlled reel selection valve for selecting a set of hydraulic wheel hubs, said reel selection valve used to activate the operation of its respective reel with all other reels inactive.

12. An operator controlled, hydraulically powered, bidirectional rotation, variable speed, triple reel assembly for winding or unwinding oil and/or gas well wireline cable or coiled tubing, comprising:

a frame;

three reels each having first and second ends;

three sets of first and second hydraulic wheel hubs, each hydraulic wheel hub having a rotating and non-rotating member;

each set of first and second hydraulic wheel hubs are positioned coaxially within and at opposite ends of a corresponding reel respectively, wherein said wheel hub rotating members are fixedly attached to said reel and said wheel hub non-rotating members are fixedly attached to said frame whereby each of said reels are rotatably attached to said frame;

pumping means for pumping hydraulic fluid in a closed loop wherein the direction and flow rate of the pumped fluid may be operator controlled;

said closed loop including said hydraulic wheel hubs; and means for operator control of said pump means whereby the operator controls the rotational speed and direction of said reel;

operator controlled first and second valves for selectively controlling hydraulic fluid flow to each set of said first and second hydraulic wheel hubs respectively, said first and second control valves allowing the circulation of fluid to prevent fluid cavitation in said hydraulic wheel hubs when said wheel hubs are rotating and either or both of the respective control valves are closed;

said first hydraulic wheel hub having a larger displacement than said second hydraulic wheel hub for different rotational speed and torque requirements of said reel;

means for reducing the displacement of said first and second hydraulic wheel hubs, said reducing means connected to and operated by said operator control means for an additional rotational speed and torque ranges for said reel;

a pneumatic reel brake independently slowing or stopping the rotation of said reel, said reel brake controllable from said operator control means;

said hydraulic fluid pump and control means comprising a variable displacement multi-piston pump, a variable position swash plate integral with said multi-piston pump, said swash plate position determining the direction and amount of fluid flow from said pump, an electrohydraulic means for controlling the position of said swash plate, a swash plate position potentiometer, said position potentiometer connected to said swash plate for indicating position thereof;

said operator control means comprising a coil driver, said driver electrically connected to and powering said electrohydraulic position means for controlling the position of said swash plate, means for closed loop servo control of said swash plate position, a lever action potentiometer joy stick connected to said servo control means, said joy stick used by the operator to control the required fluid direction and flow rate to said wheel hubs, a set of reel selector switches for selecting reel operation and a set of wheel hub speed/torque selector switches for selecting total reel wheel hub displacement;

said swash plate position potentiometer, said joy stick and said coil driver all connected to said servo control means to function as a closed loop servo control system for the purpose of controlling and rapidly changing the position of said swash plate which controls the direction and flow rate of the hydraulic fluid to said hydraulic wheel hubs;

a jarring switch for maintaining cable tension, said jarring switch preventing said joystick and servo loop control means from allowing said reel to unwind the cable in tension; and said reel selector and speed/torque switches used for controlling which set of reel wheel hubs are operating and what displacement is engaged while said wheel hub set is running.

* * * * *

UNITED STATES PATENT AND TRADEMARK OFFICE

CERTIFICATE OF CORRECTION

PATENT NO. : 5,176,364
DATED : January 5, 1993
INVENTOR(S) : Danny R. Bell

It is certified that error appears in the above-indentified patent and that said Letters Patent is hereby corrected as shown below:

Title page, item [73], Assignee: change "Camo" to -- Camco --.

Signed and Sealed this

Fifth Day of April, 1994

Bruce Lehman

*Attest:*

BRUCE LEHMAN

*Attesting Officer*

*Commissioner of Patents and Trademarks*